US006038994A

United States Patent [19]

Ford et al.

[11] Patent Number: 6,038,994

[45] Date of Patent: Mar. 21, 2000

[54] SMALL BOAT SUPPORT AND RIGGING APPARATUS AND METHOD OF USE

[76] Inventors: Wayne N. Ford; Jerri M. Ford, both of 19401 Newhaven La., Huntington Beach, Calif. 92646

[21] Appl. No.: 09/259,205

[22] Filed: Mar. 1, 1999

Related U.S. Application Data

[63] Continuation-in-part of application No. 08/977,533, Nov. 25, 1997, abandoned.

[51] Int. Cl.[7] ..... B63B 35/40

[52] U.S. Cl. ..... 114/259; 114/365

[58] Field of Search ..... 114/44, 255, 365

[56] References Cited

U.S. PATENT DOCUMENTS

| | | | |
|---|---|---|---|
| 4,526,126 | 7/1985 | Dunn | 114/635 |
| 4,763,593 | 8/1988 | Lasko | 114/44 |
| 4,850,295 | 7/1989 | Weaver | 114/259 |
| 4,964,358 | 10/1990 | Sandrow | 114/368 |
| 5,018,475 | 5/1991 | Burke | 114/365 |
| 5,133,275 | 7/1992 | Maurizio | 114/259 |

FOREIGN PATENT DOCUMENTS

| | | | |
|---|---|---|---|
| 936828 | 11/1973 | Canada | 114/259 |

*Primary Examiner*—Jesus D. Sotelo
*Attorney, Agent, or Firm*—Eric Karich

[57] ABSTRACT

The present invention provides a support and rigging apparatus and a method of use for securing a small craft to a vessel afloat in a body of water. The apparatus has a plurality of support arms for supporting the small craft. The arms, each, provide a first arm portion which is attached to and extend rearwardly from the vessel, and a second arm portion which has a length that is less than half of the beam of the small craft, and is positioned adjacent to the water surface. A perpendicular connecting portion connects the first and second arm portions. The perpendicular connecting portion preferably extends upwardly from the second arm portion and slidably engages a coupling sleeve attached to the first arm portion, thereby allowing the position of the second arm portion to be adjusted. The invention preferably further provides a dinghy line for removably attaching the small craft to an upwardly extending portion of the support arms, and a second line for lifting the small craft out of the water such that the beam of the craft is substantially vertical.

12 Claims, 8 Drawing Sheets

SMALL BOAT SUPPORT AND RIGGING APPARATUS AND METHOD OF USE

This application is a continuation-in-part of a previously filed application having the same title, inventors, and having application Ser. No. 08/977,533, filed Nov. 25, 1997, now abandoned.

BACKGROUND OF THE INVENTION

1. Field of the Invention

This invention relates generally to a carrying device for a dingy, and more particularly to a support and rigging apparatus for stowing a dingy on the stem of a larger vessel.

2. Description of Related Art

The following art defines the present state of this field:

Dunn, U.S. Pat. No. 4,256,126 describes a device for storing and carrying an inflatable pontoon boat on a yacht. The device features upwardly opening hooks that engage a pontoon so that the boat may rest against the stem of the yacht. The hooks are supported on a post attached to a stem pulpit. The boat may be hoisted upwardly using a line attached to one pontoon and then into the hooks in which position the boat is fastened in place with line.

Sandrow, U.S. Pat. No. 4,964,358 describes a dinghy rigging mechanism designed to permit the expeditious recovery, hoisting and stowing of a small boat or dinghy in an upright position at the stem of a main vessel. The invention is devised to be readily detached from the main vessel and stowed to avoid unsightly presence of the equipment when it is not being used.

The rigger equipment may be detachably affixed for use directly on the transom of a vessel or adapted to be detachably secured at the trailing edge of a swim platform. The mechanism is devised to dip into the water, allowing the small boat or dinghy to be floated into position on the arms of the rigging apparatus. Since the dinghy is recovered while being maintained upright, the outboard motor or steering equipment need not be removed from the dinghy in order to recover and stow the small craft on the vessel.

Burke, U.S. Pat. No. 5,018,475 describes a bracket for securing a dinghy to a yacht. The bracket has a member adapted to fit over one of the pontoon portions of the dinghy. The bracket has, at one end thereof, an element for removably securing the member to the yacht. The bracket also comprises a mounting assembly for mounting the member to the dinghy.

Maurizio, U.S. Pat. No. 5,133,275 describes the onboard dinghy cradle which comprises a framework of hollow tubings which are secured together by fittings and connectors. The framework produced includes bottom cross members which extend across the width of the dinghy at a predetermined distance below the bottom surface thereof. Side tubings are also provided for positioning one side of the dinghy close to a supporting surface for the cradle, such as a swim platform, and to keep the dinghy from moving away as it is being boarded or left. The cradle is pivotally mounted to the supporting structure so it can be pivoted to a vertical storage position, having the dinghy, with or without a small motor attached thereto, up and out of the water.

Weaver, U.S. Pat. No. 4,850,295 describes a davit for an inflatable dinghy or other small inflatable boat including a pair of lock devices secured to the stem of the carrier boat for engaging and supporting hanger assembly mounted on the inflatable dinghy and enabling the dinghy, to be swung between in-water and out-of-water positions, and a pair of stand-off brackets attached to the stem of the carrier boat that support the inflatable dinghy in its raised out-of water position. Each hanger assembly has an outboard catch supported by a resilient, flexible pad which in turn is adhesively secured to the dinghy sidewall or causing the support pad to separate therefrom.

Lasco, U.S. Pat. No. 4,763,593, discloses a mechanical device for lifting a dinghy out of the water and storing the dinghy on the side of the water along side a conventional dry dock.

The prior art teaches various large cradles and various hoist and davit systems. However, the prior art does not teach an invention which provides the stability of a support cradle and the simplicity and ease of use of a simple hoist. The present invention fulfills these needs and provides further related advantages as described in the following summary.

SUMMARY OF THE INVENTION

The present invention teaches certain benefits in construction and use which give rise to the objectives described below.

The present invention provides a support and rigging apparatus and a method of use for securing a small craft to a vessel afloat in a body of water. The apparatus has a plurality of support arms for supporting the small craft. The arms, each, provide a first arm portion which is attached to and extends rearwardly from the vessel, and a second arm portion which is less than half the beam of the small craft, and is positioned adjacent to the water surface. The first arm is preferably attached to the second arm with a means for adjusting the height of the second arm portion relative to the vessel.

A primary objective of the present invention is to provide support and rigging apparatus and a method of use for securing a small craft to a vessel afloat in a body of water having advantages not taught by the prior art.

Another objective is to provide an apparatus with a second arm portion that is less than half of the beam of the small craft, thereby allowing the small craft to be easily pulled onto the platform and secured to the vessel even when the small craft is loaded with people and an outboard motor. The second arm portion serves to secure and stabilize the small craft so its contents and passengers can easily be unloaded onto the vessel. The second arm portion can then be used to store the small craft for transport.

A further objective is to provide an apparatus that can be adjusted to fit any vessel, and also readjusted as needed while the vessel is in use. During use, the vessel's displacement changes according to the weight loaded onto the vessel. As passengers board or disembark, and as fuel is burned, the vessel rises or falls in the water, thereby requiring the apparatus to be readjusted to its proper position adjacent to the surface of the water. The novel adjustment means allows the apparatus to function even after the vessel changes its ordinary position in the water.

A further objective is to provide an apparatus which does not completely cover the swim step of the vessel, with or without the small craft, thus leaving the aft portion of the vessel and the swim step available for other use.

A further objective is to provide an apparatus which is easily removable to clear the swim step for other use.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
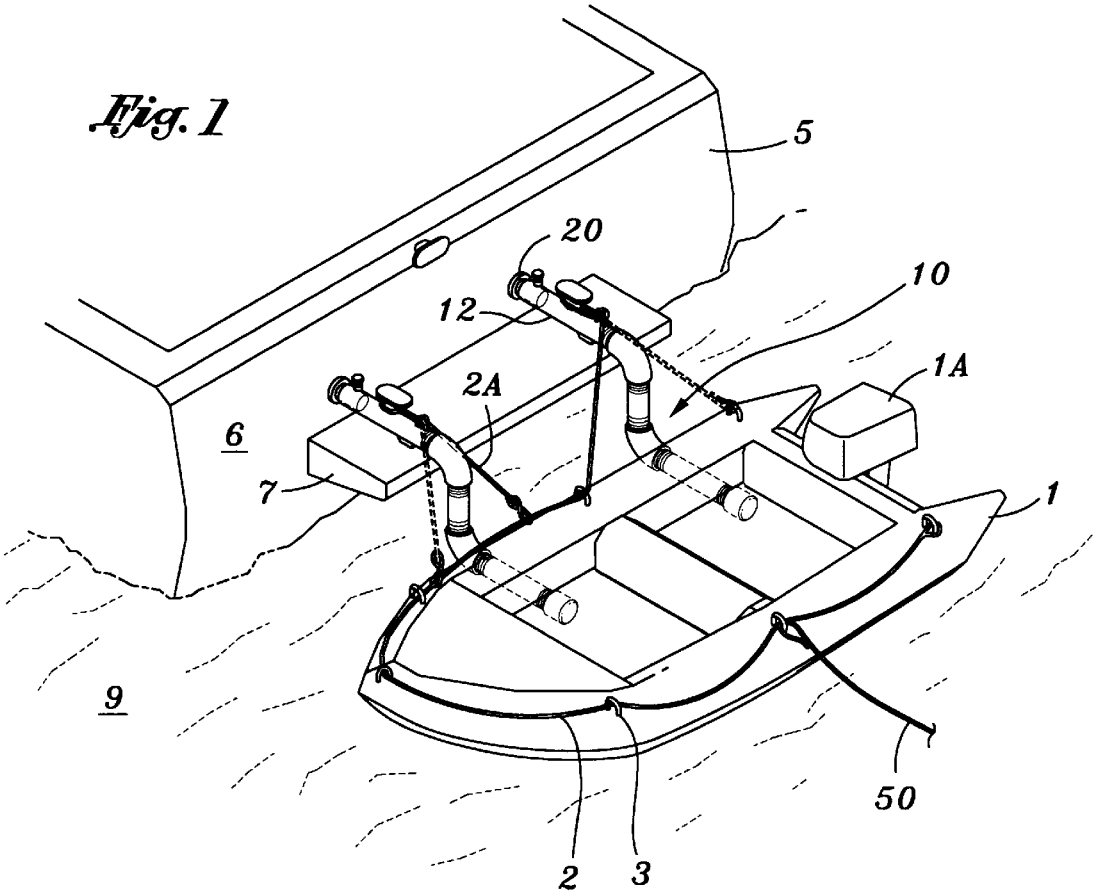
FIG. 1 is a perspective view of a first embodiment of the present invention, showing a pair of support arms attached to a transom of a vessel and a dinghy pulled onto a second arm portions of the support arms but not yet hoisted out of the water.

The above described drawing figures illustrate the invention, a support and rigging apparatus for securing a small craft 1 such as a dinghy to a vessel 5 afloat in a body of water 8. As shown in FIG. 1, the apparatus has a plurality of support arms 10 for supporting the small craft 1. The arms 10, each, providing a first arm portion 12 joined to, and extending rearwardly from, the vessel 5. The arms, each, further provide a second arm portion 14 that is positioned adjacent to a water surface 9 of the body of water 8 when the vessel 5 is in use. In the preferred embodiment, the second arm portion 14 is preferably attached to the first arm portion 12 with a means for adjusting 40 the height of the second arm 24 portion relative to the vessel 3.

Figure 8:
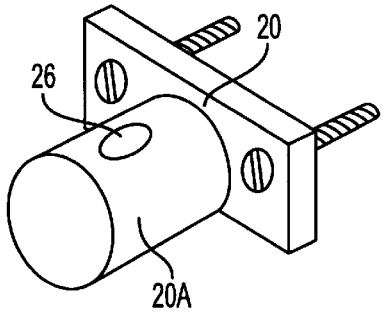
FIG. 8 is a perspective view of a mounting bracket used to attach the invention to the vessel.
Figure 9:
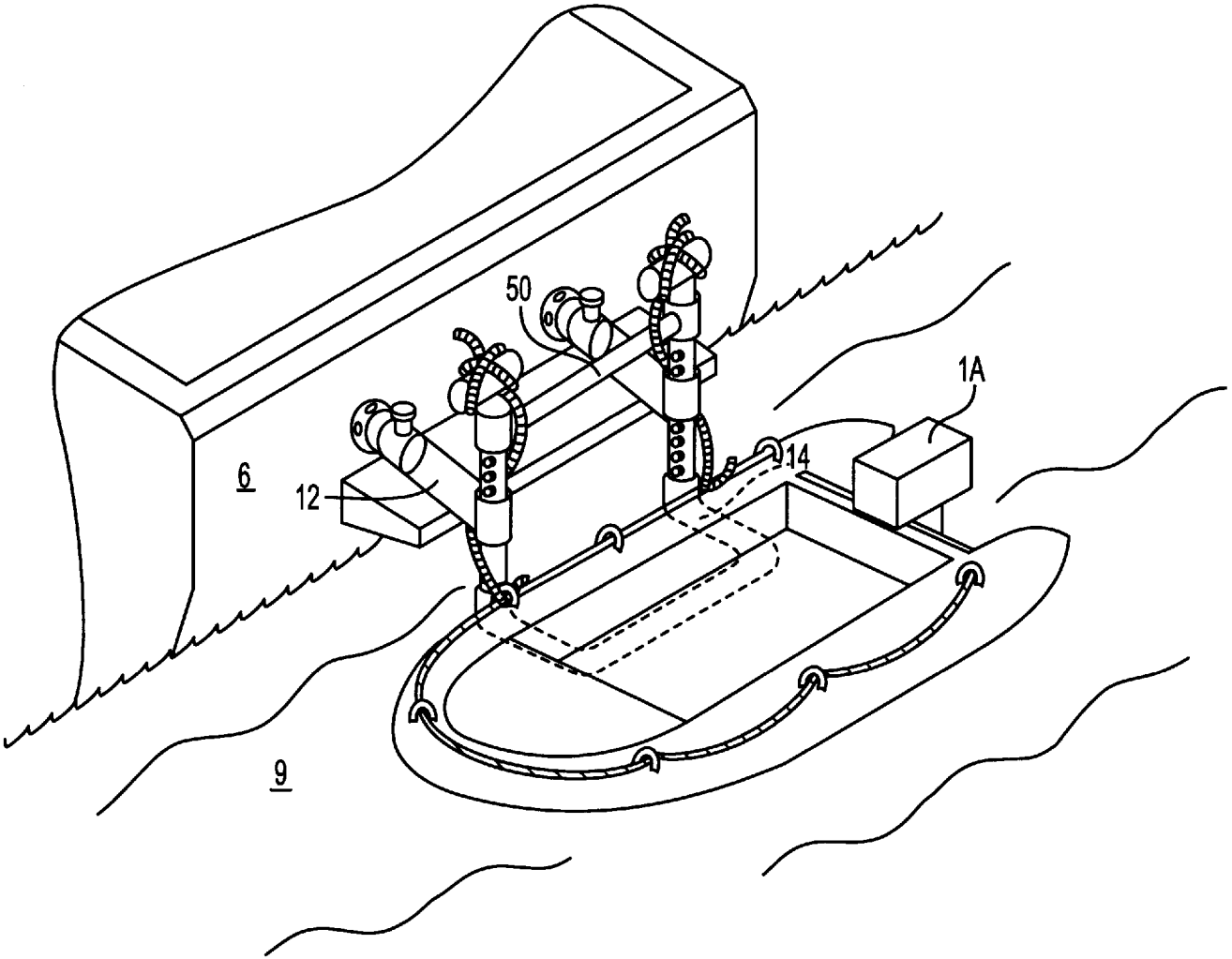
FIG. 9 is a perspective view of the preferred embodiment, showing the pair of support arms attached to the transom of the vessel and the dinghy pulled onto a second arm portions of the support arms.
Figure 10:
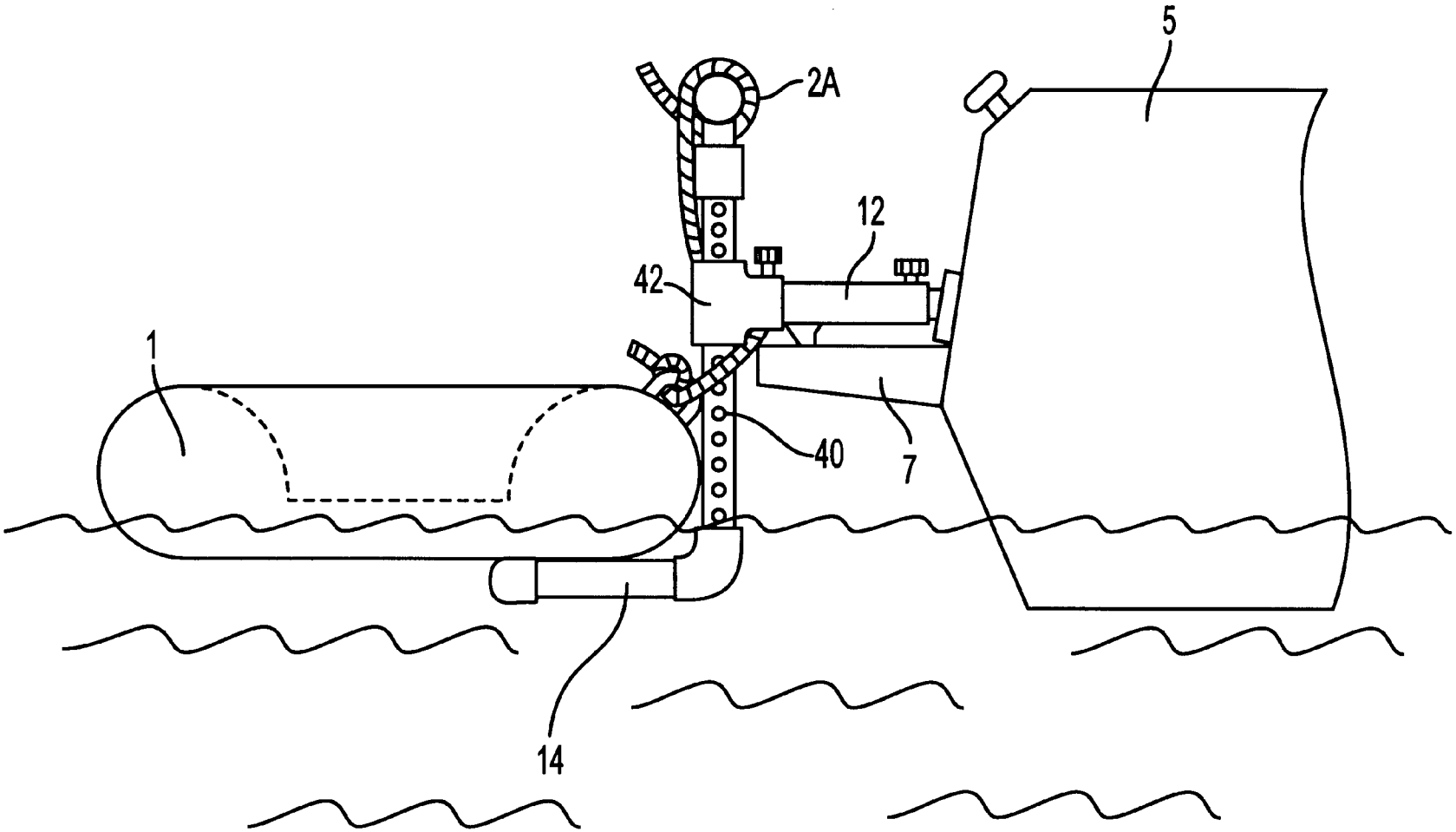
FIG. 10 is a side elevational view thereof.
Figure 11:
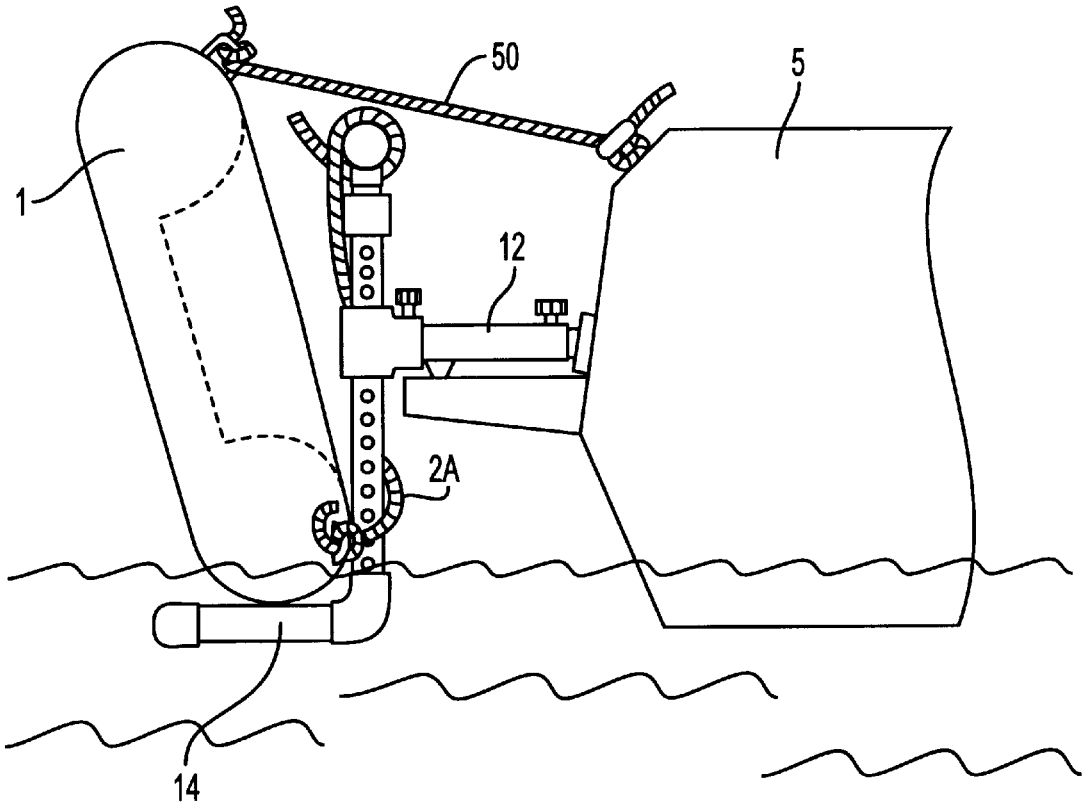
FIG. 11 is a side elevational view thereof once the dinghy has been pulled out of the water with the second line.
Figure 12:
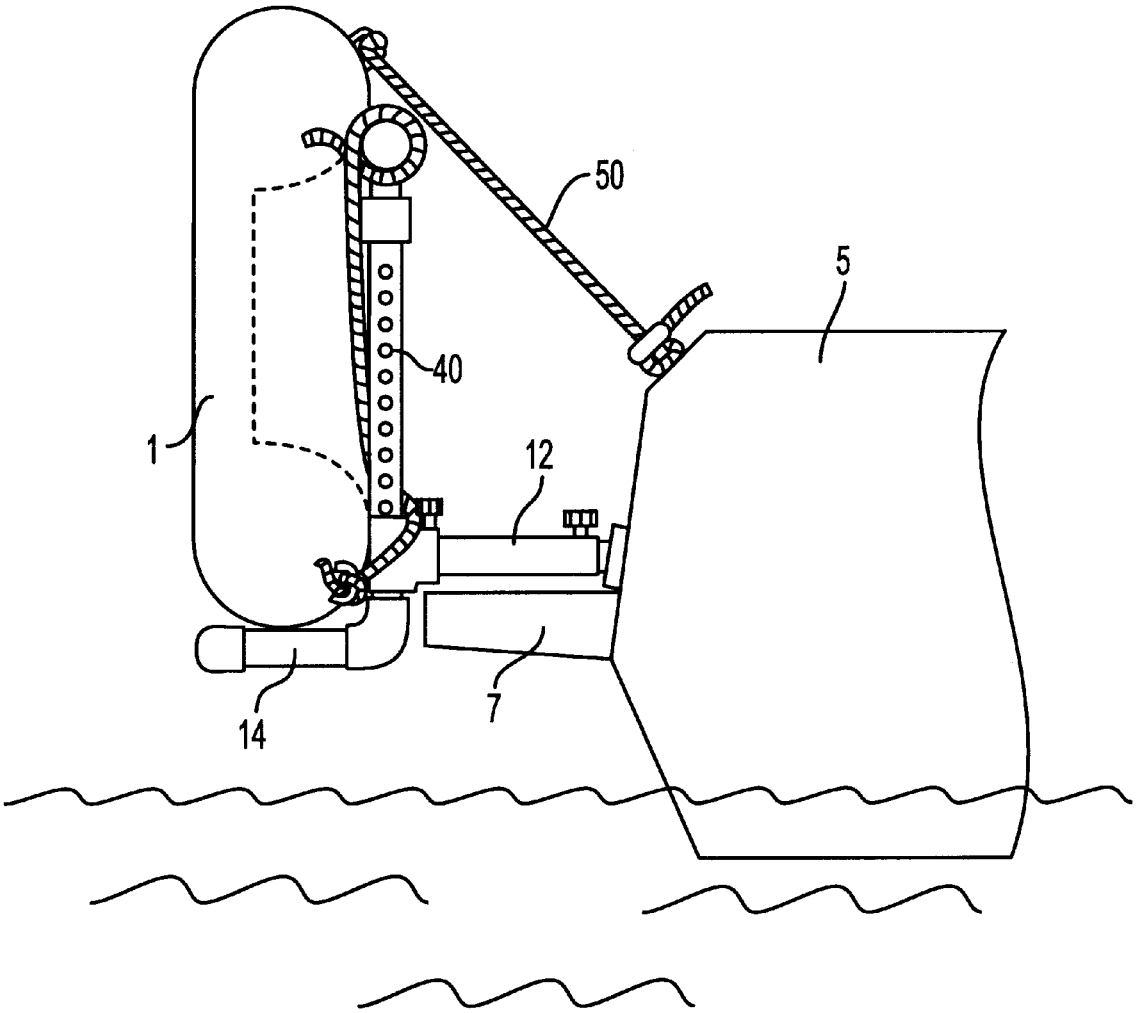
FIG. 12 is a side elevational view thereof once the dinghy and the second arm portion have been pulled out of the water to long-term storage position.

The support arms 10 are preferably made of rigid material which does not deteriorate or rust in an ocean environment, preferably plastic pipe such as 2 inch schedule 40 PVC pipe. The size and quality of the pipe is not critical, as long as the pipe is strong enough to support the small craft 1. The first arm portion 12 is preferably sold as a piece of PVC pipe approximately 2–3 feet long; and the user cuts the pipe to custom fit the length of the swim step 7. The first arm portion 12 is attached to the vessel 3 with a mounting bracket 20. The mounting bracket 20 is shown in FIG. 8, and described more fully below.

Figure 5:
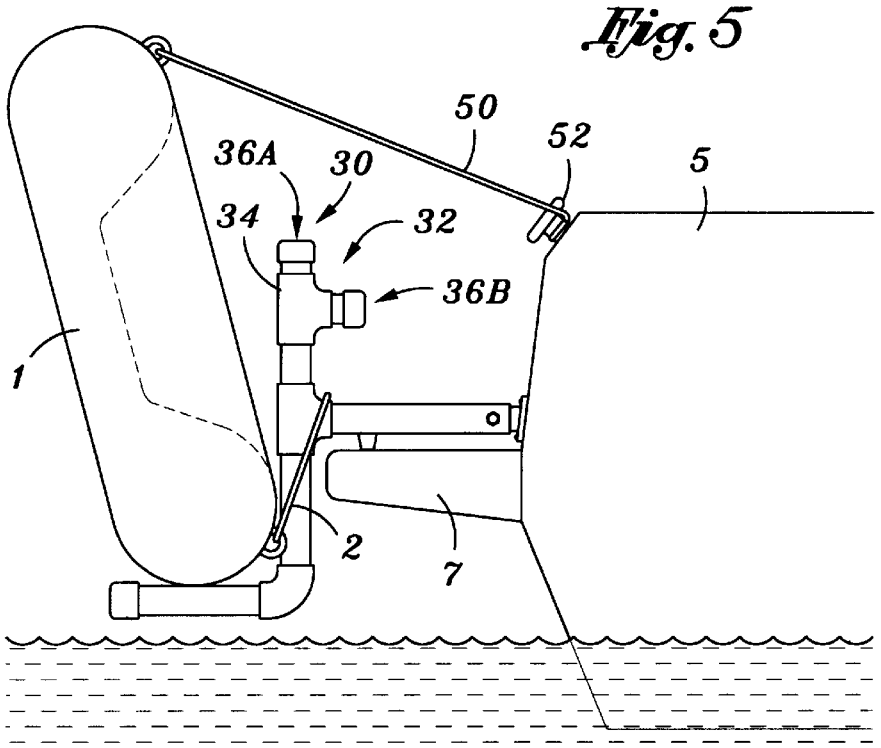
FIG. 5 is a side elevational view showing a second embodiment of the invention, in which a dinghy line is used to fasten the dinghy to an upwardly extending portion having a notch.
Figure 6:
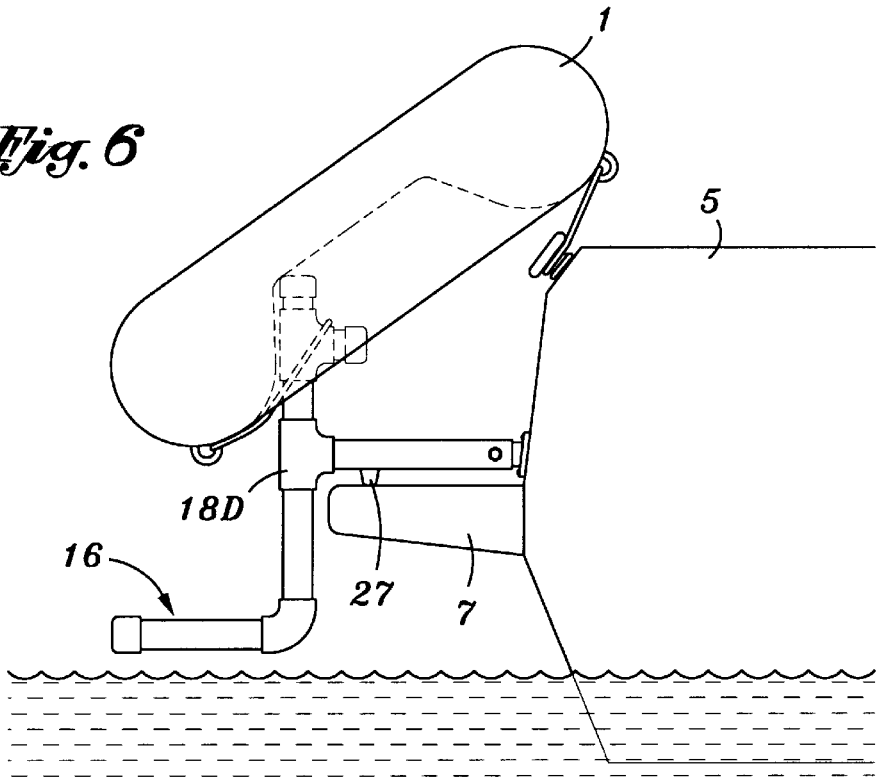
FIG. 6 is a side elevational view thereof, with the small craft lifted above the second arm portion and into a more secure and long term storage position, with the dinghy line resting in the notch.
Figure 7:
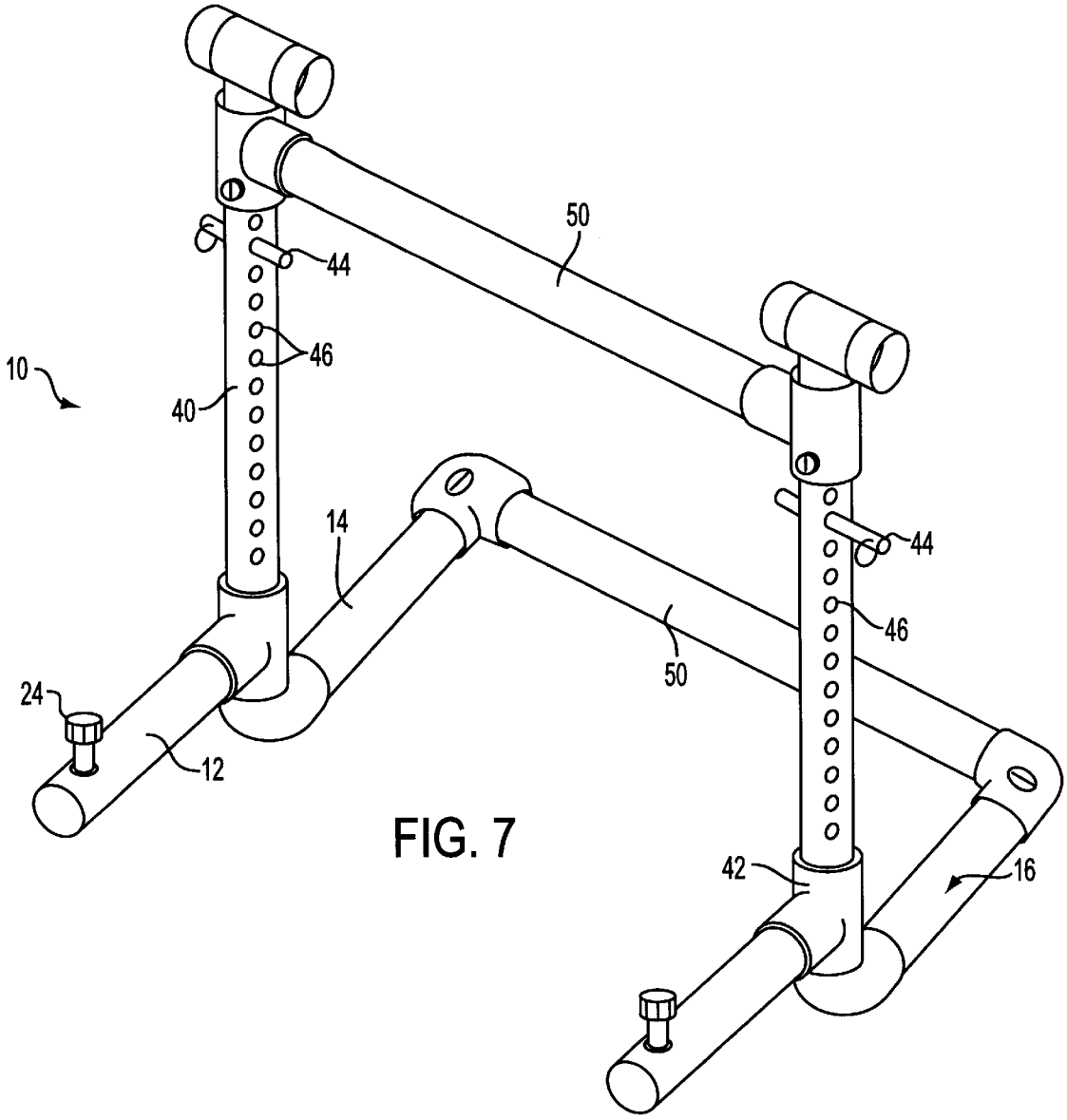
FIG. 7 is a perspective view of the preferred embodiment of the invention.

The second arm portion 14 of each of the support arms 10 is shorter than half the beam of the small craft 1; and it is preferred that the length of the second arm portion 14 be approximately the same as the maximum draft of the small craft 1, generally less than two feet. The second arm portion 14 is preferably positioned parallel to and just below the water surface 9 so that its upwardly facing surface 16 is functional for supporting the small craft 1 thereupon while the small craft 1 is further supported by the water surface 9. By shortening the length of the second arm portion 14, preferably to a relatively small size, it is possible to lift the small craft 1 onto the second arm portions 14, even when the small vessel 1 is fully loaded, without breaking the second arm portions 14, because the bulk of the craft is still being supported by the water 8. The second arm portions 14 provide stability to the small craft 1 while it is still in the water, thereby allowing the small craft 1 to be unloaded with ease. Stability is especially important for installing or removing the outboard motor 1A that is usually used on the small craft 1. FIG. 1 shows the outboard motor 1A mounted on the small craft 1, while FIGS. 2–6 show the small craft 1 with the outboard motor 1A removed for storage of the small craft 1. These support arms 10 also allow the small craft 1 to be raised out of the water for storage In the preferred embodiment, as shown in FIGS. 7–12, the second arm portion 14 is preferably attached to the first arm portion 12 with a means for adjusting 40 the height of the second arm 24 portion relative to the vessel 3. The means for adjusting 40 allows the second arm portion 14 to be moved from a first position, preferably just under the water surface 9, to a second position, substantially above the water surface 9. The means for adjusting 40 is preferably a perpendicular connecting portion 40 extending upwardly from the second arm 14 portion to slidably engage a coupling sleeve 42 attached to the first arm portion 12. The perpendicular connecting portion 40 preferably has a locking means 44 for locking the second arm portion 14 into a particular position with respect to the vessel. The locking means 44 is preferably a locking pin 44 that engages one of a plurality of holes 46 in the perpendicular connecting portion. The locking pin 44 operates to block the perpendicular connecting portion 40 from sliding through the coupling sleeve 42. In the most preferred embodiment, as shown in FIG. 7, the invention has two support arms 10. The second arm portions 14 and the perpendicular connecting portions 40 of the pair of support arms 10 are preferably connected with cross bracing members 50 for stability and strength. The means for adjusting 40 allows the plurality of support arms 10 to be adjusted to fit vessels 5 of different sizes. The means for adjusting 40 allows the position of the second support portion 14 to be adjusted during use, an important capability because the second support portion 14 is preferably positioned just under the water surface. Since the vessel 5 rises and falls as the weight of the vessel 5 changes (as the number of passengers changes, the amount of gas goes down, etc.), some adjustment mechanism is greatly preferred. The means for adjusting 40 also allows the small craft 1 to be hoisted further out of the water for long term storage.

Figure 2:
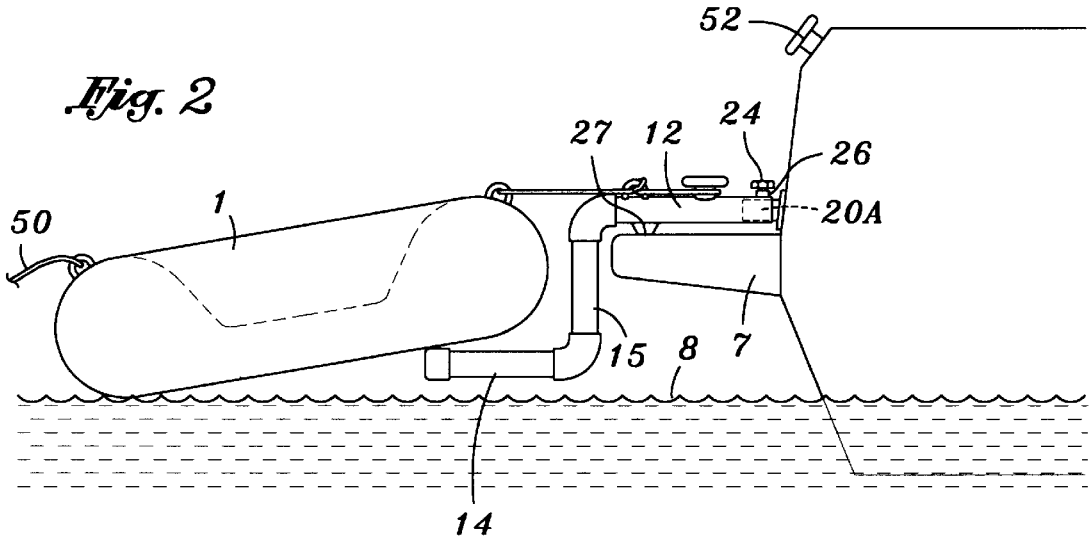
FIG. 2 is a side elevational view thereof, showing a first line and a first cleat being used to attach the dinghy to the vessel.
Figure 3:
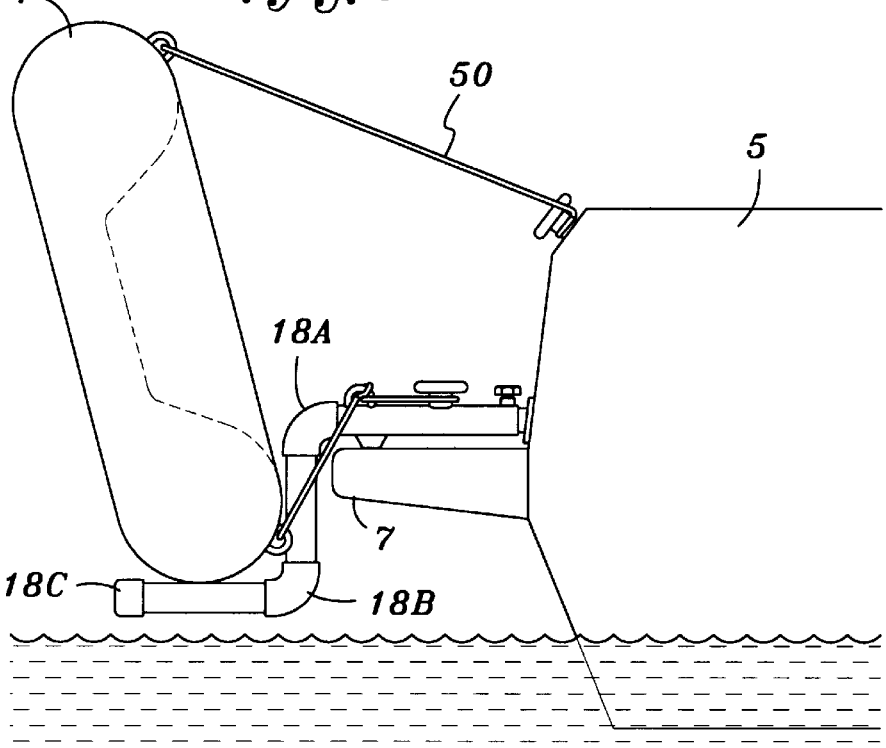
FIG. 3 is a side elevational view of the dinghy after it has been hoisted out of the water with a second line, the dinghy resting in a temporary storage position.

In addition to the preferred embodiment, which relies on the means for adjusting 40 for adjusting the position of the second arm portion 14, other structures known in the art can also be used, such as telescoping support arms 10 and mounting brackets with different adjustment positions. In an alternative embodiment of this invention, as shown in FIG. 2, the adjustment means is achieved by making the support arms 10 out of three different elements: a first arm portion 12 and a parallel second arm portion 14, both connected with a perpendicular connecting portion 15. The support arms 10 are originally sold as three separate pieces 12, 14, and 15, which can be cut so that the support arms 10 are sized to fit the individual vessel 5. After they have been cut to the correct size, the three pieces 12, 14, and 15 can be assembled and glued together with two schedule 40 PVC elbows 18A and 18B to form the support arm 10. In an alternative embodiment, described in greater detail below, the elbow 18A is replaced by a T-joint 18D. A schedule 40 PVC end cap 18C preferably seals the end of the second arm portion 14 opposite the elbow 18B.

Figure 4:
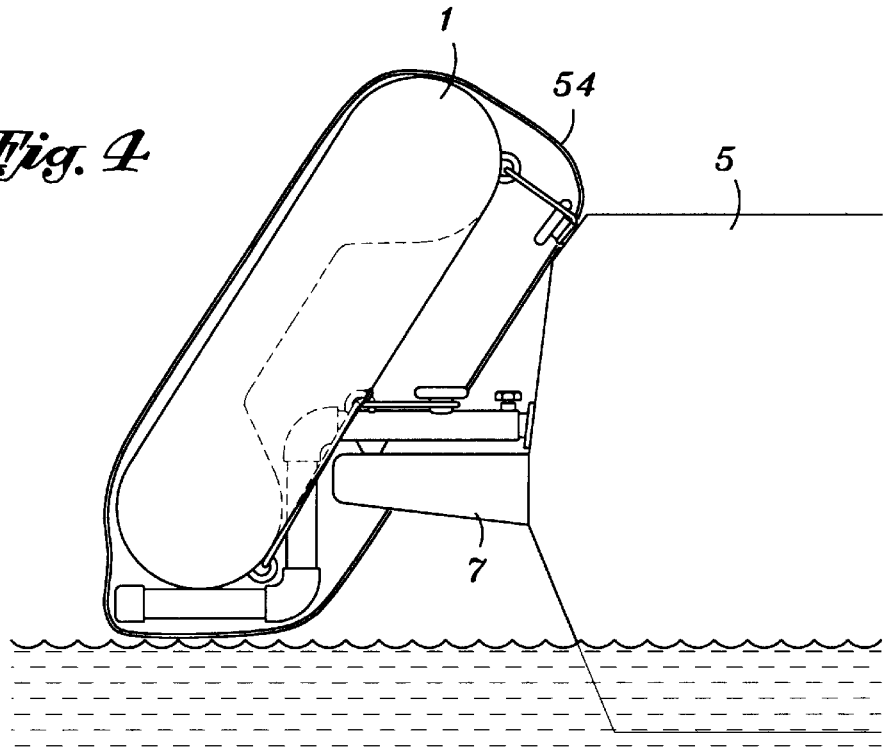
FIG. 4 is a side elevational view of the dinghy tied down and covered with a tarpaulin, in a long term storage position.

Once the support arm 10 has been assembled, the first arm portion 12 is connected to the vessel 5. Many different mechanisms for connecting a support arm to a vessel 5 as well known in the art. The support arms 10 can be connected to a swim step 7 or to the transom 6 of the vessel 5, either above or below the swim step 7. The following patents show various attachment means, and are hereby incorporated by reference in full: Dunn, U.S. Pat. No. 4,256,126, Sandrow, U.S. Pat. No. 4,964,358, Burke, U.S. Pat. No. 5,018,475, Maurizio, U.S. Pat. No. 5,133,275, and Weaver, U.S. Pat. No. 4,850,295. In its preferred embodiment, the first arm portion 12 is connected to the transom 6 with a mounting bracket 20 which is attached, preferably with screws (not shown), to the transom 6 above the swim step 7. A male member 20A of the mounting bracket 20 fits inside the first arm portion 12. A locking bolt 24 is inserted through a locking hole 26 in the first arm portion 12 and engages the male member 20A of the mounting bracket 20. In a preferred embodiment, the locking bolt 24 is a Clevis™ pin. As shown in FIGS. 5–6, the locking hole 26 is preferably located on the side of the first arm portion 12 so that the locking bolt 24 is inserted horizontally. This arrangement is preferred because it increases the lateral stability of the support arms 10. In an alternative embodiment, shown in FIGS. 1–4, the locking bolt 24 is inserted vertically, making access to the screw or bolt easier. The first arm portion 12 preferably also has a bumper 27 such as a rubber ring which is attached to the first arm portion 12 with a screw (not shown). The bumper 27 supports the first arm portion 12 on the swim step 7 to stabilize the support arms 10 and to prevent the support arms 10 from scratching the swim step 7.

The invention preferably includes a first attachment means for removably attaching the small craft 1 to either the transom 6 of the vessel 5, the swim step 7, or at least one of the support arms 10. This first attachment means is preferable because it facilitates attaching the small craft 1 to the vessel 5. As shown in FIGS. 5–6, the first attachment means is preferably an upwardly extending portion 30 extending vertically from each of the support arms 10. The upwardly extending portion 30 is preferably formed by substituting the elbow 18A with a T-Joint 18D, as described above. Further tubing can then be added to build the upwardly extending portion 30 upwards. Further details of this structure are provided below. The small craft 1 such as a dinghy preferably has a dinghy line 2 which runs the length of the small craft 1 and is attached at various points with a plurality of dinghy brackets 3. As shown in FIG. 5, the user loops the dinghy line 2 over the upwardly extending portion 30 to secure the small craft 1 to the vessel 5. If the dinghy line 2 is not long enough for this purpose, the user ties a supplemental dinghy line 2A to the dinghy line 2B and ties or loops this supplemental dinghy line 2A to the upwardly extending portion 30. FIG. 1 shows the use of both the dinghy line 2 and the supplemental dinghy line 2A. Further benefits of the upwardly extending portion 30 are described below. In an alternative embodiment, shown in FIGS. 1–4, the first attachment means is a first cleat 40 which is used to secure a first line 42. At least one of the support arms 10 has the first cleat 40 permanently attached to its first arm portion 12. The first line 42 is removably attached to the first cleat 40, preferably by wrapping the first line 42 around the first cleat 40 in a figure-eight configuration. As described in more detail below, the first line 42 is attached to the dinghy line 2, either with a knot or a locking mechanism such as a snap hook. The first line 42 is pulled inwards and upwards until the small craft 1 is drawn onto the second arm portion 14 and the dinghy line 2 is pulled over the first arm portion 12. The first line 42 is then removably attached to the first cleat 40 by wrapping the first line 42 in a figure-eight around the first cleat 40. It is worth noting that the first attachment means can be achieved with many devices well known in the art, including but not limited the following examples. In one alternative embodiment, the first attachment means is simply a rope which attaches to the dinghy at one end and a cleat attached to the vessel at the other end. This cleat can be attached almost anywhere on either the vessel 5 or the support arms 10. In another embodiment, the first arm portion 12 has a protrusion (not shown); and the dinghy line 2 described above is looped over the protrusion. In a final embodiment, a rope attached to the small craft 1 simply wraps around one of the support arms 10. Many similar means well known in the art can be imagined and are within the scope of this invention. Once the small craft has been secured to the vessel 5, a tarpaulin 54 is wrapped around the small craft 1, as shown in FIG. 4.

In its preferred embodiment, the upwardly extending portion 30 described above includes a notch 32 for receiving the dinghy line 2. This notch 32 can be formed with many varying structures on the upwardly extending portion 30, including a notch, catch or crook integral with the upwardly extending portion 30, or a hook attached thereto. As shown in FIGS. 5–6, the notch 32 is preferably formed with a second T-joint 34 with a first and second capped pipe 36A and 36B extending horizontally and vertically therefrom. Once the small craft 1 has been hoisted onto the second arm portions 14 of the support arms 10, the small craft 1 is raised off the second arm portion 14 and the dinghy line 2 is placed in the notch 32. As shown in FIG. 6, this serves to hold the small craft 1 above the second arm portion 14, preferably by approximately 8 inches. This places the small craft 1 in a more permanent storage position, above the water surface 9 and any waves or wakes thrown up by the vessel while it is in motion.

In its preferred embodiment, the invention includes a hoisting means 50 such as at least one second line. One second line 50 is preferred, but additional lines may be used for added stability. The second line 50 is attached to the small craft 1, preferably by tying the second line 50 to the dinghy line 2 or one of the dinghy brackets 3, on the side of the small craft 1 which is opposite the vessel 5. Other attachment mechanisms are well known, such as snap hooks and other locking mechanisms. The second line 50 is then pulled in, either by hand or with the assistance of a mechanical device such as a winch, until the small craft 1 is lifted out of the body of water 8. Finally, the second line 50 is removably attached to the vessel 5, preferably by wrapping the second line 50 around a boat cleat 52 which is securely fastened to the vessel 5 with screws (not shown) or similar fastening means.

The invention also includes a method for securing the small craft 1 to the vessel 5 with the above described invention. The first step is to provide a plurality of support arms 10 as described above, each, providing a first arm portion 12, a second arm portion 14, and a connection portion 15. The user then customizes the support arms 10 by cutting off a portion of the first arm portion 12 so it is approximately the same length of the swim step 7. The user then drills a locking hole 26 into the PVC pipe to accept the locking bolt 24. The user then cuts off part of the connection portion 15 so it its length is slightly shorter than the distance between the top of the swim step 7 and the water surface 9. The first arm portion 12 is then connected to the connection portion 15 with an elbow 18A (or the T-joint 18D). The second arm portion 14 is then connected to the opposite end of the connection portion 15 with a second elbow 18B. Finally, the open end of the second arm portion 14 is covered with a cap 18C. Each of these assembled support arms 10 is then attached to the vessel 5. Preferably, the first arm portion 12 of each of the support arms 10 is attached to a mounting bracket 20 as described above. In this configuration, the support arms 10 extend rearwardly from the vessel 5 and the second arm portions 14 are positioned adjacent to and preferably just below the water surface 9. Alternatively, as shown in FIGS. 9–12, the above-described means for adjusting 40 can be used to position the second arm portion 14 adjacent to the water surface 9.

Once the support arms 10 are in place, the user positions the small craft 1 transversely to the vessel 5 adjacent to the aft portion thereof. The user then secures the dinghy line 2 to the small craft 1, preferably to a plurality of dinghy brackets 3. The user then pulls the dinghy line 2 to bring the small craft 1 at least partially onto the upwardly facing surface 16 of the second arm portions 14. The user then attaches the dinghy line 2 to the vessel 5, preferably by looping the dinghy line 2 over an upwardly extending portion 30, as shown in FIG. 5. If the dinghy line 2 is not long enough to be lifted over both of the upwardly extending portions 30, a supplemental dinghy line 2A is tied to the dinghy line 2 and looped over the upwardly extending portion 30. Use of the supplemental dinghy line 2A is shown in FIG. 1.

Once the small craft 1 is attached to the vessel 5, a second line 50 is attached to the small craft 1, as described above. The second line 50 is then pulled in to rotate the small craft 1 so that the beam of the small craft 1 is approximately in a vertical attitude; and, as described above, the second line 50 is then secured to the vessel 5, to secure the small craft 1 in a stored position. To further secure the small craft 1, it is preferred that the upwardly extending portion 30 include a notch 32. By lifting the small craft 1 until the dinghy line 2 can be fitted into the notch 32, it is possible to suspend the small craft 1 above the second arm portion 14, as shown in FIG. 6. This position has the advantage of lifting the small craft 1 well out of the water, thus preventing waves or wakes from knocking the small craft 1 off the support arms 10 while the vessel 5 is in transit.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A support and rigging apparatus for securing a small craft to a vessel afloat in a body of water, the apparatus comprising:

a plurality of support arms for supporting the small craft, the arms, each, providing a first arm portion joined to, and extending rearwardly from, the vessel, the arms, each, further providing a second arm portion positioned adjacent to a water surface of the body of water, the second arm portion of each of the support arms providing an upwardly facing surface extending under and contacting the bottom of the small craft functional for supporting the small craft thereupon adjacent to the water surface, the second arm portion having a length that is less than half of the beam of the small craft.

2. The apparatus of claim 1 further comprising:

a dinghy line attached to the small craft;

a first cleat attached to the first arm portion of at least one of the support arms; and a first line which removably attaches the dinghy line to the first cleat.

3. The apparatus of claim 1 further comprising:

a dinghy line attached to the small craft; and an upwardly extending portion of the support arm, the upwardly extending portion formed integrally with the first arm portion, the dinghy line removably attachable to the upwardly extending portion.

4. A support and rigging apparatus for securing a small craft to a vessel afloat on a surface of a body of water, the apparatus comprising:

a plurality of support arms for supporting the small craft, the arms, each, providing a first arm portion that is attachable to the vessel with an attachment means, and a second arm portion providing an upwardly facing surface extending under and contacting the bottom of the small craft functional for supporting the small craft thereupon, the second arm portion having a length less than half of the beam of the small craft, the second arm portion being attached to the first arm portion with a means for adjusting the height of the second arm portion relative to the vessel.

5. The apparatus of claim 4 wherein the means for adjusting allows the second arm portion to be moved from a first position, just under the water surface, to a second position, substantially above the water surface.

6. The apparatus of claim 4 wherein the means for adjusting includes a perpendicular connecting portion extending upwardly from the second arm portion to slidably engage a coupling sleeve attached to the first arm portion, the perpendicular connecting portion having a locking means for locking the second arm portion into a particular position with respect to the vessel.

7. The apparatus of claim 6 wherein the locking means includes a plurality of holes through the perpendicular connecting portion and a locking pin that fits through a selected hole, the pin then operates to block the perpendicular connecting portion from sliding through the coupling sleeve.

8. A method for securing a small craft to a vessel, the method comprising the steps of:

a) engaging a plurality of support arms at the stern of the vessel for supporting the small craft, the support arms, each, providing a first arm portion engaging the vessel, and a second arm portion at approximately the ship's water line;

b) positioning the small craft transversely to the vessel adjacent to the aft portion thereof, c) pulling a dinghy line of the small craft to bring the small craft at least partially onto the second arm portions;

d) securing a second line to the small craft;

e) pulling the second line to rotate the small craft so that the beam of the small craft is approximately in a vertical attitude; and f) securing the small craft in a stored position on the support arms with the second line.

9. The method of claim 8 further comprising the step of:

a') cutting the plurality of support arms to an appropriate length so they are customized to fit the vessel.

10. The method of claim 8 further comprising the step of:

e') removably attaching the dinghy line to at least one of the support arms.

11. The method of claim 8 further comprising the steps of:

a') providing an upwardly extending portion attached to the first arm portion;

e') removably attaching the dinghy line to at least one of the upwardly extending portions.

12. The method of claim 8 further comprising the steps of:

a') providing an upwardly extending portion attached to the first arm portion, the upwardly extending portion having a notch;

j) lifting the small craft until the dinghy line fits within the notch, thereby suspending the small craft above the second arm portion.

* * * * *